United States Patent [19]

Gmelin

[11] Patent Number: 4,982,711

[45] Date of Patent: Jan. 8, 1991

[54] APPARATUS FOR ACTUATING A THROTTLE VALVE IN INTERNAL COMBUSTION ENGINES

[75] Inventor: Karl Gmelin, Flein, Fed. Rep. of Germany

[73] Assignee: Robert Bosch GmbH, Stuttgart, Fed. Rep. of Germany

[21] Appl. No.: 478,395

[22] Filed: Feb. 12, 1990

[30] Foreign Application Priority Data

Feb. 24, 1989 [DE] Fed. Rep. of Germany ..... 3905675

[51] Int. Cl.[5] ..... F02D 7/00

[52] U.S. Cl. ..... 123/399

[58] Field of Search ..... 123/399, 361, 352; 180/178, 179; 74/96, 522, 571 M

[56] References Cited

U.S. PATENT DOCUMENTS

| | | | |
|---|---|---|---|
| 4,579,017 | 4/1986 | Nüsser | 74/96 |
| 4,616,518 | 10/1986 | Nüsser | 74/519 |
| 4,655,180 | 4/1987 | Bauer et al. | 123/361 |
| 4,721,176 | 1/1988 | Kabasin et al. | 123/399 |
| 4,809,659 | 3/1989 | Tamaki et al. | 123/399 |
| 4,850,322 | 7/1989 | Uthoff et al. | 123/399 |
| 4,869,220 | 9/1989 | Iondehl | 123/399 |
| 4,915,074 | 4/1990 | Arai | 123/399 |

*Primary Examiner*—Raymond A. Nelli

*Attorney, Agent, or Firm*—Edwin E. Greigg

[57] ABSTRACT

An apparatus for actuating a throttle valve secured on a throttle valve shaft in internal combustion engines has an adjusting lever which is seated in a manner fixed against relative rotation on the throttle valve shaft and is actuatable by a pivot lever on the one hand, and on the other, when the pivot lever is stationary, by an electromotive throttle valve adjuster. With a pivot lever bush, the pivot lever is seated on a split taper socket secured to the throttle valve shaft. For restoring the adjusting lever, a decoupling spring is provided, which is disposed on a split guide sleeve surrounding the pivot lever bush and is braced, with its tangentially offstanding spring ends, on the pivot lever and adjusting lever. To avoid friction losses in the rotation of the adjusting lever relative to the fixed pivot lever, the split taper socket protrudes axially on the swivel lever bush, and one sleeve part of the spring guide sleeve is secured to the split taper socket in the protruding region.

16 Claims, 2 Drawing Sheets

APPARATUS FOR ACTUATING A THROTTLE VALVE IN INTERNAL COMBUSTION ENGINES

BACKGROUND OF THE INVENTION

The invention relates to an apparatus for actuating a throttle valve, secured to a throttle valve shaft, in internal combustion engines in particular in motor vehicles.

In such actuation apparatuses, the pivot lever is actuated by the driver via a pulley and a coupling link. Via a carrier, the pivot lever rotates the adjusting lever, which in turn pivots the throttle valve shaft and the throttle valve secured to it. To govern engine idling, the electromotive throttle valve adjuster acts upon the adjusting lever via a setting screw. In the resultant rotation of the adjusting lever the pivot lever is retained by the coupling link, and decoupling spring provides for a restoring force of the throttle valve counter to the servomotor. Since the working capacity of the servomotor is limited, the restoring force of the decoupling spring must not be excessively great. On the other hand, upon the return of the servomotor the restoring force must be sufficiently strong to assure both the restoration of the adjusting lever and switching, effected by the adjusting lever in its terminal position, of an actuation contact on the throttle valve adjuster.

In a known apparatus of the type described above, the decoupling spring is embodied for safety reasons as a symmetrical double spring, comprising two helical springs axially one behind the other, abutting one another at the face end and also abutting a radially offstanding annular flange of the spring guide sleeve, which is split in two transversely to the axial direction. One of the two sleeve parts of the spring guide sleeve is pressed axially against the adjusting lever. The two sleeve parts mesh with one another at the dividing line, so that the helical springs cannot become caught in the gap between the sleeve parts. If a wire of one helical spring should break, then the other helical spring still has sufficient restoring moment for the adjusting lever.

In this construction, the decoupling spring presses axially against the spring guide sleeve, and one sleeve part in turn presses against the adjusting lever. Upon rotation of the adjusting lever by the throttle valve adjuster, the result is relatively high friction between the stationary spring guide sleeve and the rotating adjusting lever and the end of the decoupling spring that rotates the adjusting lever. However, in the presence of such friction losses, the demand for a small actuating force of the adjusting lever counter to the restoring force of the decoupling spring, which is advantageous for the throttle valve adjuster servomotor, and the demand for sufficiently safe return of the adjusting lever by the decoupling spring upon the return of the servomotor, even if one of the two helical spring wires breaks, cannot be met.

OBJECT AND SUMMARY OF THE INVENTION

A throttle valve actuating apparatus according to the invention, has an advantage that the above-described source of friction is completely eliminated, since the adjusting lever, the spring end engaging it, and the part of the spring guide sleeve located in this region rotate in common, or in other words without relative motion with respect to one another, upon actuation of the adjusting lever by the servomotor.

In a preferred feature of the invention, a simple connection between one part of the spring guide sleeve and the split taper socket of the adjusting lever is obtained if the sleeve part is embodied as an extrusion coating of lubricating plastic in the region where the split taper socket protrudes outside the pivot lever bush. Embodying the decoupling spring as a symmetrical double spring comprising two helical springs abutting one another at the ends thus provides the plastic extrusion coating, in a preferred feature of the invention, with a radially offstanding annular flange abutted on the end by one helical spring. The other helical spring, which as before is axially braced on the spring guide sleeve mounted on the pivot lever bush and thus is stationary, is the source of only relatively low coefficients of friction, which are tolerable.

If it is desirable to eliminate even this relatively low friction, a further embodiment of the invention provides that the decoupling spring is embodied as a double wound torsion spring. Since this eliminates axial pressing forces of the decoupling spring, the annular flange on the sleeve parts of the spring guide sleeve can then be dispensed with as well.

Simplification of production techniques is obtained if in accordance with a further embodiment of the invention the part of the spring guide sleeve remaining on the pivot lever bush is directly formed on this bush jointly with it. Manufacturing the pivot lever bush of lubricant plastic such as TEFLON lowers the friction between the split taper socket and the pivot lever bush.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
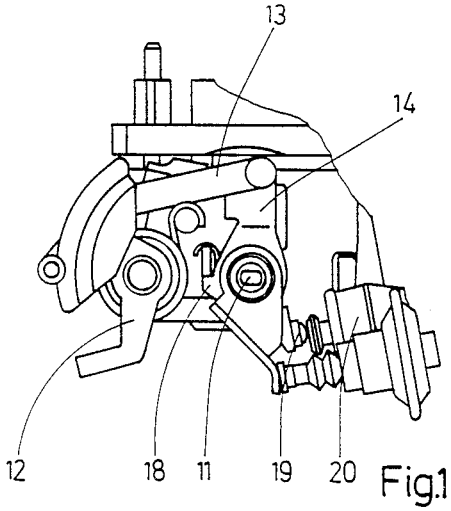
FIG. 1 is a detail showing a side view of an actuating apparatus for a throttle valve of an internal combustion engine.
Figure 2:
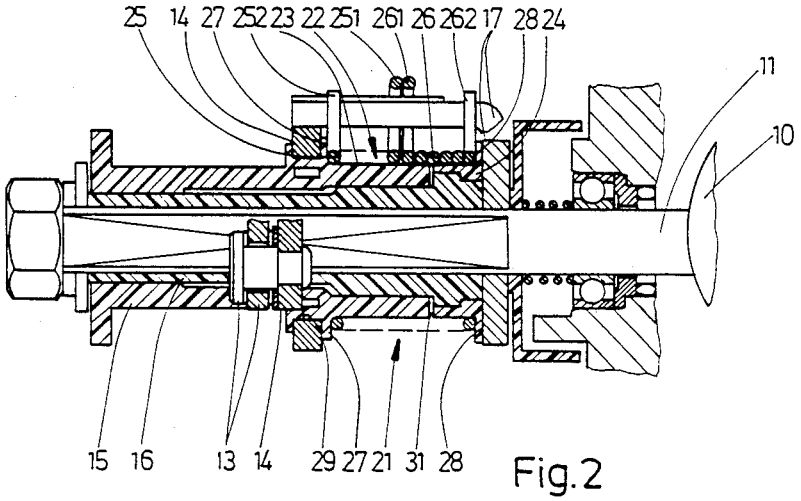
FIG. 2 is a detail showing a longitudinal section through the actuating apparatus in the region of the throttle valve shaft, on a larger scale.

In the apparatus, seen in part in a side view in FIG. 1 and in a longitudinal section in FIG. 2, for actuating a throttle valve 10 of an internal combustion engine in a motor vehicle, the rotation of a pulley 12, brought about by the driver via a cable, is transmitted to a pivot lever 14 via a connecting rod 13; with a pivot lever bush 15, the pivot lever is rotatably mounted on a split taper socket 16 that is connected by form-fitting engagement to the throttle valve shaft 11 in a manner secured against relative rotation. An adjusting lever 17 is likewise connected to the throttle valve shaft 11 in a manner fixed against relative rotation. The pivot lever 14 has a carrier dog 18, which rests on the adjusting lever 17 and upon rotation of the pivot lever 14 carries the adjusting lever 17 with it, which in turn pivots the throttle valve shaft 11 and thus the throttle valve 10.

For governing engine idling, a throttle valve adjustment is effected by an electromotive throttle valve adjuster 20, which directly engages the adjusting lever 17 via a setting screw 19. For restoring the adjusting lever 17 upon the return of the throttle valve adjuster 20, a cylindrical decoupling spring 21 is provided; this spring coaxially surrounds the split taper socket 16 and pivot lever bush 15 and is received in a spring guide sleeve 22 that is split in two transversely to the axial direction and is braced with tangentially offstanding spring ends on the adjusting lever 17 and pivot lever 14, respectively. In all three exemplary embodiments shown in FIGS. 2–4, the split taper socket 16 protrudes axially from the pivot lever bush 15, and in this protruding region it carries one sleeve part 23 of the spring guide sleeve 22. The other part 24 of the spring guide sleeve 22 is secured on the pivot lever bush 15. In all three exemplary embodiments, the sleeve part 23 is formed in the protruding region by a lubricant plastic extrusion coating of the split taper socket 16.

Figure 3:
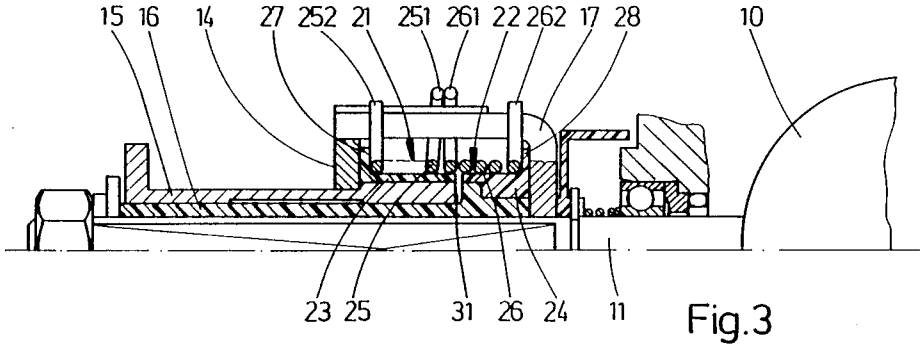
FIGS. 3 and 4 are details showing a longitudinal section through the actuating apparatus of FIG. 1 in the vicinity of the throttle valve shaft, in accordance with a second and third exemplary embodiment, respectively.

In the two exemplary embodiments of FIGS. 2 and 3, the decoupling spring 21 is embodied as a symmetrical double spring, comprising two helical springs 25, 26 disposed one after the other in the axial direction. The two helical springs 25, 26 abut one another at the face end and are pressed in the axial direction against a respective annular flange 27 or 28 on the sleeve part 23 or 24. The annular flange 28 on the sleeve part 24 is formed in the process of forming the plastic extrusion coating of the split taper socket 16. The sleeve parts 23, 24 are asymmetrical; for example, the sleeve part 23 mounted on the pivot lever bush 15 is longer than the sleeve part 24 mounted on the split taper socket 16. As a result, the dividing gap 31 between the sleeve parts 23, 24 is not located at the point where the two helical springs 25, 26 abut, and so these springs cannot slide into the gap and cause jamming. Each helical spring 25 or 26 is braced with a respective spring end 251 or 261 on the pivot lever 14 and with the other spring end 252 or 262 on the adjusting lever 17, so that upon rotation of the adjusting lever 17 by the throttle valve adjuster 20, with the pivot lever 14 restrained by the connecting rod 13 and pulley 12, the two helical springs 25, 26 generate a restoring moment for the adjusting lever 17.

In the exemplary embodiment of FIG. 2, the pivot lever bush 15 is made of lubricant plastic, and the sleeve part 23 having the annular flange 27 of the spring guide sleeve 22 is formed integrally onto the pivot lever bush 15. The pivot lever 14 is fastened in a hub 29 of the pivot lever bush 15. In the exemplary embodiment of FIG. 3, the sleeve part 23 joined to the pivot lever bush 15 is embodied as a separate component.

Upon rotation of the adjusting lever 17 by the throttle valve adjuster 20, the split taper socket 16, the sleeve part 24 integrally formed onto it, and the helical spring 26 that rests with its spring end 262 on the adjusting lever 17 are the parts that rotate with the adjusting lever 17. As a result, there is no relative motion between stationary and rotating parts, and no friction whatever arises, even in the reverse rotation of the adjusting lever 17 during the return of the throttle valve adjuster 20. As a result, the restoring force of the decoupling spring 21 can be of relatively small magnitude, even though provision is made for the reliable restoration of the adjusting lever 17, which is advantageous for the throttle valve adjuster 20, since it typically has a limited working capacity. Slight frictional forces arise only between the stationary sleeve part 23, specifically its annular flange 27, and the face end of the helical spring 25, the end 252 of which rotates with the rotation of the adjusting lever 17. However, this friction is quite low and can be tolerated.

Figure 4:
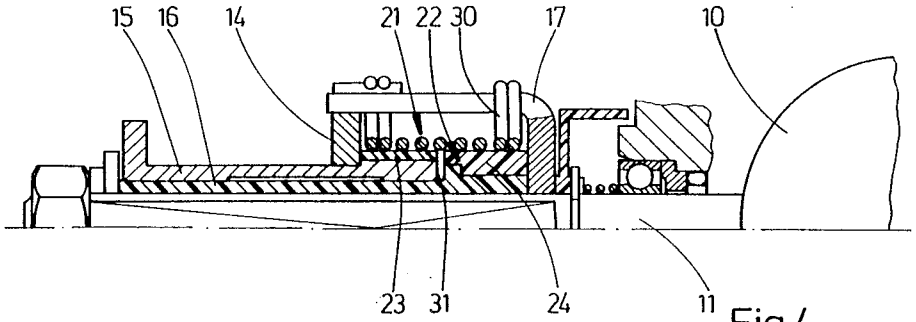

If even that friction is to be eliminated, then in accordance with FIG. 4 the decoupling spring 21 is embodied as a double-wound torsion spring 30, with approximately half of it seated on the sleeve part 23 firmly joined to the pivot lever bush 15 and the other half seated on the sleeve part 24 firmly joined to the split taper socket 16. The annular flanges of the sleeve parts 23, 24 are omitted here. The ends of each spring wire are again braced on each other between the pivot lever 14 and the adjusting lever 17. With this double-wound torsion spring 30 as well, adequately high restoring moment remains for the adjusting lever 17, in the event that one spring wire should break.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An apparatus for actuating a throttle valve secured on a throttle valve shaft in internal combustion engines, having an adjusting lever seated on the throttle valve shaft in a manner fixed against relative rotation, a carrier on a pivot lever, the adjusting lever being actuatable on the one hand by said carrier on said pivot lever rotatably seated with a bush on a split taper socket (16) secured for rotation with the throttle valve shaft, and on the other hand by an electromotive throttle valve adjuster, and having a cylindrical decoupling spring embodied as a torsion spring which is disposed on a spring guide sleeve split in two transversely to the axial direction and encompassing the pivot lever bush, said decoupling spring is braced with its tangentially protruding spring ends on the adjusting lever and pivot lever, for restoration of the adjusting lever upon actuation by the throttle valve adjuster, the split taper socket (16) protrudes axially out of said pivot lever bush (15), and one sleeve part (23) of the spring guide sleeve (22) is secured to the split taper socket (16) in the protruding region.

2. An apparatus as defined by claim 1, in which said sleeve part (24) of the spring guide sleeve (22) joined to the split taper socket (16) is embodied by a lubricant plastic.

3. An apparatus as defined by claim 1, in which said sleeve part (23) of the spring guide sleeve (22) is integrally formed onto the pivot lever bush (15).

4. An apparatus as defined by claim 2, in which said sleeve part (23) of the spring guide sleeve (22) is integrally formed onto the pivot lever bush (15).

5. An apparatus as defined by claim 1, in which said decoupling spring (21) is embodied as a symmetrical double spring comprising two helical springs (25, 26) in axial succession, which abut one another at their adjacent ends and abut a respective annular flange (27, 28) radially protruding from each sleeve part (23, 24).

6. An apparatus as defined by claim 2, in which said decoupling spring (21) is embodied as a symmetrical double spring comprising two helical springs (25, 26) in axial succession, which abut one another at their adjacent ends and abut a respective annular flange (27, 28) radially protruding from each sleeve part (23, 24).

7. An apparatus as defined by claim 3, in which said decoupling spring (21) is embodied as a symmetrical double spring comprising two helical springs (25, 26) in axial succession, which abut one another at their adjacent ends and abut a respective annular flange (27, 28) radially protruding from each sleeve part (23, 24).

8. An apparatus as defined by claim 4, in which said decoupling spring (21) is embodied as a symmetrical double spring comprising two helical springs (25, 26) in axial succession, which abut one another at their adjacent ends and abut a respective annular flange (27, 28) radially protruding from each sleeve part (23, 24).

9. An apparatus as defined by claim 5, in which said sleeve parts (23, 24) are embodied asymmetrically, with different axial lengths.

10. An apparatus as defined by claim 6, in which said sleeve parts (23, 24) are embodied asymmetrically, with different axial lengths.

11. An apparatus as defined by claim 7, in which said sleeve parts (23, 24) are embodied asymmetrically, with different axial lengths.

12. An apparatus as defined by claim 8, in which said sleeve parts (23, 24) are embodied asymmetrically, with different axial lengths.

13. An apparatus as defined by claim 1, in which said decoupling spring (21) is embodied as a double-wound torsion spring (30).

14. An apparatus as defined by claim 2, in which said decoupling spring (21) is embodied as a double-wound torsion spring (30).

15. An apparatus as defined by claim 3, in which said decoupling spring (21) is embodied as a double-wound torsion spring (30).

16. An apparatus as defined by claim 4, in which said decoupling spring (21) is embodied as a double-wound torsion spring (30).

* * * * *